United States Patent [19]

Ando

[11] Patent Number: 5,033,894

[45] Date of Patent: Jul. 23, 1991

[54] MECHANICAL PENCIL WITH TAPERED SUPPLY CHAMBER

[75] Inventor: Yoichi Ando, Yokohama, Japan

[73] Assignee: Mitsubishi Pencil Co., Ltd., Tokyo, Japan

[21] Appl. No.: 105,269

[22] Filed: Oct. 7, 1987

[51] Int. Cl.[5] ..... B43K 21/00; B43K 21/04

[52] U.S. Cl. ..... 401/65; 401/85; 401/94

[58] Field of Search ..... 401/85, 94, 65, 67

[56] References Cited

U.S. PATENT DOCUMENTS

| | | | |
|---|---|---|---|
| 1,262,859 | 4/1918 | Smith | 401/94 X |
| 1,621,990 | 3/1927 | Lippert et al. | 401/85 X |
| 1,636,207 | 7/1927 | Bartholomew | 401/57 |
| 1,693,579 | 11/1928 | Straka | 401/85 |
| 2,436,437 | 2/1948 | Koch | 401/67 |
| 4,358,210 | 11/1982 | Hashimoto et al. | 401/94 X |
| 4,371,277 | 2/1983 | Kageyama et al. | 401/65 X |
| 4,627,756 | 12/1986 | Kageyama | 401/94 |

FOREIGN PATENT DOCUMENTS

| | | | |
|---|---|---|---|
| 68797 | 9/1940 | Czechoslovakia | 401/65 |
| 154073 | 9/1985 | European Pat. Off. | 401/85 |
| 433700 | 4/1948 | Italy | 401/67 |
| 667235 | 2/1952 | United Kingdom | 401/65 |

*Primary Examiner*—Steven A. Bratlie

*Attorney, Agent, or Firm*—Oliff & Berridge

[57] ABSTRACT

A knock-out type mechanical pencil which comprises a lead containing tube in which the inner and outer walls thereof are so tapered that the lead inlet thereof is larger in diameter than the opposite end thereof. The mechanical pencil further comprises a spring supporting ring interposed between the clamping ring so attached to the outer periphery of a chuck portion integrally formed with the lead guide of the lead containing tube and spiral springs to oppose with the base end of the ferrule within the outer barrel for urging the spring supporting ring to the ferrule. Thus, this mechanical pencil can eliminate the lead jams in the lead containing tube and lead breakage therein.

1 Claim, 1 Drawing Sheet

MECHANICAL PENCIL WITH TAPERED SUPPLY CHAMBER

BACKGROUND OF THE INVENTION

This invention relates to an improvement in a knock-out type mechanical pencil and, more particularly, to a knock-out type mechanical pencil in which the inner and outer walls of a lead containing tube inserted in a tubularly cylindrical body or an outer barrel are so tapered that the lead inlet of the lead containing tube is larger in diameter than the opposite end thereof.

The lead containing case or body inserted into an outer barrel of a conventional knock-out type mechanical pencil has the same diameter at both ends. When a number of leads are filled in the lead containing case, the leads tend to jam the passage of the lead to cause the lead not to be fed into a guide hole. When small number of leads are filled in the lead containing case, the leads collide with each other in the lead containing case so as to cause the leads to be possibly broken.

Since the conventional knock-out type mechanical pencil generally employs fine leads, the lead tends to easily break due to excessive writing pressure applied to the outer barrel thereof. In case the lead jams the guide hole in the mechanical pencil, a ferrule must be detachably threaded, in order to clean the jammed lead in the guide hole, into the end of the outer barrel. In this case the ferrule has such a disadvantage that the ferrule tends to be readily loosened and to be possibly lost.

SUMMARY OF THE INVENTION

It is therefore an object of this invention to provide a knock-out type mechanical pencil which eliminates the aforementioned disadvantages of the conventional knock-out type mechanical pencil.

Another object of this invention is to provide a knock-out type mechanical pencil to which leads can be easily filled from the lead inlet of a lead containing tube.

Yet another object of this invention is to provide a knock-out type mechanical pencil which can be readily fabricated by automatic assembling work.

A further object of this invention is to provide a knock-out type mechanical pencil in which leads filled in a lead containing tube may not be disposed irregularly therein but be fed one by one into a guide hole and in which even small number of leads filled in the lead containing tube may not be filled irregularly therein nor be collided with each other to cause the leads not to be easily broken.

Still another object of this invention is to provide a knock-out type mechanical pencil in which no friction between leads and an outer barrel occurs at knocking time.

Still another object of this invention is to provide a knock-out type mechanical pencil which can prevent breakage of leads due to excessive writing pressure applied to the outer barrel.

Still another object of this invention is to provide a knock-out type mechanical pencil which can prevent the looseness of a ferrule caused by large friction between the ferrule and the threaded portion of an outer barrel.

Still another object of this invention is to provide a knock-out type mechanical pencil which can precisely control the lead feeding distance thereof.

Still another object of the invention is to provide a knock-out type mechanical pencil which can be easily fabricated and assembled in a simple construction capable of exact assembly such as by screwing a chuck to a lead containing tube.

DESCRIPTION OF THE PREFERRED EMBODIMENTS

Figure 1:
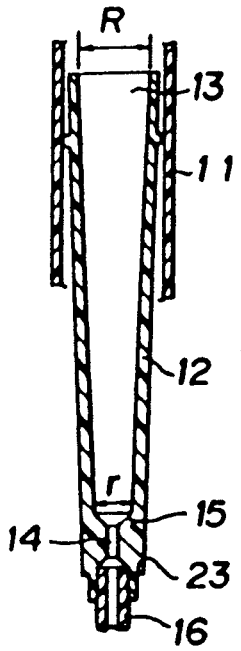
FIG. 1 is a sectional view of a lead containing tube disposed within a knock-out type mechanical pencil constructed according to this invention.
Figure 2:
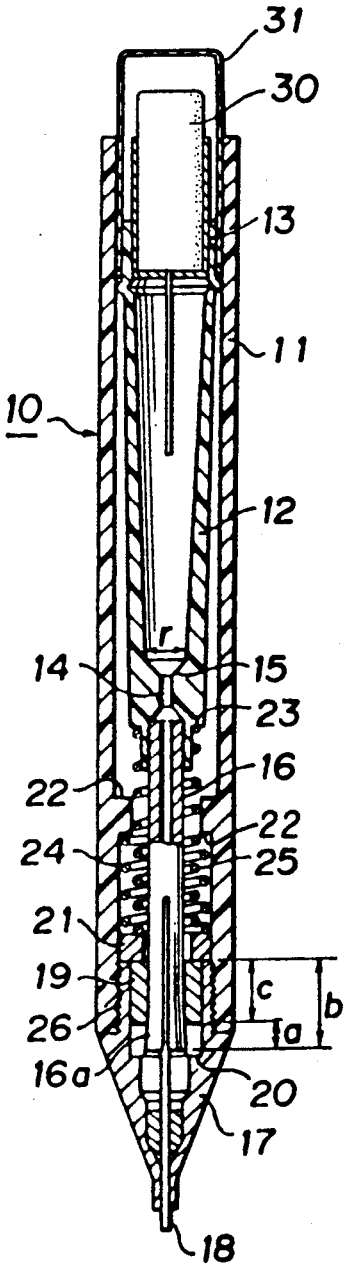
FIG. 2 is a longitudinal sectional view of the knock-out type mechanical pencil of this invention.

Reference is now made to the drawings, FIGS. 1 and 2, which show one preferred embodiment of the knock-out type mechanical pencil constructed according to this invention wherein like reference numerals designate the same parts in the drawings.

A knock-out type mechanical pencil 10 of this invention comprises a lead containing tube 12 in a tubularly cylindrical body or an outer barrel 11. A lead inlet 13 is formed at the rear end of the lead containing tube 12. An eraser 30 and a knock-out cover 31 are normally detachably attached to the lead inlet 13. A conically inclined inner surface 15 is so formed at the opposite inside end of the lead containing tube 12 to the lead inlet 13 as to easily fill the leads into a guide hole 14 perforated at the front inside end of the lead containing tube 12. The guide hole 14 is so perforated in diameter as to pass only one lead longitudinally. A lead guide 16 is fixedly secured to the guide hole 14 of the lead containing tube 12, and a chuck portion **16*a* is integrally formed with the front end of the lead guide 16. Assuming that the diameter of the lead inlet 13 of the lead containing tube 12 is represented by R and the inner diameter of the opposite end of the lead containing tube 12 to the lead inlet 13 is represented by r, the inner and outer walls of the lead containing tube 12** is so tapered as to satisfy the relationship of $R>r$.

A ferrule 17 is screwed into the front end of the outer barrel 11 and is formed with a stepped portion 20 therein to fixedly secure the chuck portion **16*a* for holding lightly a lead 18, to slidably engage a clamping ring 19 therein and to so limit the moving distance of the clamping ring 19 as to oppose with the front end surface of the clamping ring 19. Further, a spring supporting ring 21 is so disposed as to oppose with the base end of the ferrule 17 within the inside space of the outer barrel 11. Cylindrical elastic members such as spiral springs 24 and 25 are interposed between the spring supporting ring 21 and the stepped portion 22 formed on the inside surface of the outer barrel 11 as well as between the spring supporting ring 21 and the stepped portion 23 of the chuck portion 16*a*, respectively for urging the spring supporting ring 21 to the base end of the ferrule 17 and for urging the clamping ring 19 to the spring supporting ring 21. That is, when the knock-out cover 31 is knocked down, the chuck portion 16*a* slidably moves down together with the clamping ring 19. When the clamping ring 19 is thus made contact with the stepped portion 20 to cause the ring 19 to be stopped moving down, only the chuck portion 16*a* is further moved down so as to release the lead 18 therefrom. Since the lead 18 is held by the chuck portion 16*a*, the chuck portion 16*a* is, when the knock-out cover 31 is released, returned to the state shown in FIG. 1 by means of the tension of the spiral spring 25, and tightened simultaneously by the clamping ring 19 to fix the lead 18. Therefore, the lead 18 is fed out in a distance or length corresponding to the distance between the end of the clamping ring 19 and the stepped portion 20 every time the knock-out cover 31** is once knocked or depressed.

Since the lead inlet 13 of the lead containing tube 12 is advantageously formed wider in the knock-out type mechanical pencil of this type, the lead 18 can be readily filled from the lead inlet 13. Inasmuch as the inner and outer walls of the lead containing tube 12 is further tapered as mentioned above, the leads 18 in the lead containing tube 12 are not irregularly collided with each other but are introduced one by one into the guide hole 14 of the lead containing tube 12.

When excessive writing pressure is applied through the outer barrel 11 to the front end of the lead 18, the spiral spring 24 is, as shown in FIG. 2, compressed to raise integrally the spring supporting ring 21, the clamping ring 19 and the chuck portion 16*a* upwardly, so that the front end of the lead 18 is introduced into the interior of the ferrule 17. When the strength of the spiral spring 24 is suitably selected in response to the thickness and strength and the like of the lead 18, it can prevent the breakage of the lead 18 due to the excessive writing pressure applied to the outer barrel 11. Since the tension of the spiral spring 24 is normally applied through the spring supporting ring 21 to between the ferrule 17 and the outer barrel 11, it can prevent the looseness of the ferrule 17 threaded into the front end of the outer barrel 11 due to the large friction at the threaded portions 26 screwed between the ferrule 17 and the outer barrel 11. Inasmuch as the lead feeding distance or length a, in addition, depends only upon the distance b form the base end of the ferrule 17 to the stepped portion 20 and the length c of the clamping ring 19, the lead feeding distance may be precisely defined by accurately fabricating these components. Moreover, since the spring supporting ring 21 is urged to the base end of the ferrule 17, it is unnecessary to form the ferrule 17 with a sleeve or the like and to form a stepped portion for urging the sleeve to the inner surface of the ferrule 17 so as to simplify the construction of the ferrule 17. Since the side surface of the chuck portion 16*a* is not necessary to be coated with the sleeve or the like, it can facilitate an easy assembling and exact fabrication of this knock-out type mechanical pencil in case of screwing the ferrule 17 into the lead containing case 12.

It should be understood from the foregoing description that since the knock-out type mechanical pencil of this invention comprises the lead containing tube which has the inner and outer walls thereof so tapered that the lead inlet thereof is larger in diameter than the opposite end thereof and the spring supporting ring 21 so disposed as to oppose with the base end of the ferrule 17 within the inner space of the outer barrel 11, it can provide an easy introduction of leads from the lead inlet into the lead containing tube, an elimination of a number of leads filled in the lead containing tube in irregular collision with each other therein. The invention also permits introduction of leads one by one into the guide hole of the lead containing tube, an elimination of a small number of leads filled in the lead containing tube in irregular collision with each other and accordingly breakage of the leads due to collision of the leads with each other, a removal of friction of the lead with the outer barrel at knocking time, an easy positioning of the lead containing tube in the outer barrel in an automatic assembling step, convenient designing of the outer barrel, prevention of breakage of the lead due to the excessive writing pressure applied to the outer barrel and the lead. It should also be appreciated that since the spring supporting ring is urged to the base end of the ferrule in the knock-out type mechanical pencil of this invention, the pencil can be easily assembled and fabricated in a simple construction and the lead feeding distance may be accurately defined.

What is claimed is:

1. A knock-out type mechanical pencil comprising:

a tubular cylindrical tube having an inside surface, a lead containing tube adapted to contain a plurality of leads and having inner and outer walls gradually tapered so that a lead inlet formed at the rear end thereof is larger in diameter than the opposite end thereof at a point just before said inner walls become conical and form a guide hole for sequentially feeding leads one by one thereinto, a chuck portion integrally formed with a lead guide attached to the lower end of said lead containing tube, a ferrule detachably attached to said cylindrical tube, a clamping ring so attached to the outer periphery of said chuck portion as to open or close said chuck portion, a spring supporting ring interposed between said clamping ring and a stepped portion of the inside surface of said cylindrical tube, a first elastic member interposed between said spring supporting ring and said stepped portion of the inside surface of said cylindrical tube, a second elastic member interposed between said spring supporting ring and a stepped portion of said chuck portion.

* * * * *